US006993253B2

(12) United States Patent
Tazawa

(10) Patent No.: US 6,993,253 B2
(45) Date of Patent: Jan. 31, 2006

(54) HEATING APPARATUS WITH SPECIAL SELECTIVE RADIANT MATERIAL PARTIALLY COATED THEREON

(75) Inventor: Masato Tazawa, Aichi (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 0 days.

(21) Appl. No.: 10/703,636

(22) Filed: Nov. 10, 2003

(65) Prior Publication Data

US 2004/0089653 A1 May 13, 2004

(30) Foreign Application Priority Data

Nov. 12, 2002 (JP) ..... 2002-327715

(51) Int. Cl.
*H05B 3/00* (2006.01)

(52) U.S. Cl. ..... 392/407; 219/543; 219/553; 392/375

(58) Field of Classification Search ..... 392/435–439, 392/407, 375–376; 219/543, 553
See application file for complete search history.

(56) References Cited

U.S. PATENT DOCUMENTS 4,965,434 A * 10/1990 Nomura et al. ..... 392/407
4,990,747 A * 2/1991 Kondo ..... 392/435

FOREIGN PATENT DOCUMENTS

| | | |
|---|---|---|
| JP | 57-191973 | * 11/1982 |
| JP | 63-128546 | * 6/1988 |
| JP | 1-217880 | * 8/1989 |
| JP | 2-152188 | * 6/1990 |
| JP | 2-236987 | * 6/1990 |
| JP | 3-7814 | * 1/1991 |
| JP | 3-29286 | * 2/1991 |
| JP | 3-78993 | * 4/1991 |
| JP | 7-114974 | 5/1995 |
| JP | 10-24113 | * 1/1998 |
| JP | 11-322370 | 6/1999 |

* cited by examiner

*Primary Examiner*—John A. Jeffery
(74) *Attorney, Agent, or Firm*—Oblon, Spivak, McClelland, Maier & Neustadt, P.C.

(57) ABSTRACT

A heating apparatus has a spectral selective type heat radiating material having a high emissivity in a specific wavelength region. A film of the spectral selective type heat radiating material is formed on a surface of a heat radiant while leaving at least one region of the surface of the heat radiant with nothing formed thereon. The film is applied so it is possible to identify whether or not the heating apparatus is operating and to prevent the temperature of a surface of the heat radiant from rising excessively. The spectral selectivity of spectral emissivity is controlled by adjusting the thickness of the film of the spectral selective type heat radiating material.

3 Claims, 10 Drawing Sheets

HEATING APPARATUS WITH SPECIAL SELECTIVE RADIANT MATERIAL PARTIALLY COATED THEREON

BACKGROUND OF THE INVENTION

1. Field of the Invention

The present invention relates to a heating technology by using a spectral selective type heat radiating material that enables high-efficiency heating to be carried out, and more particularly to a novel type of heating apparatus that uses a heat radiant that radiates infrared radiation in a high-temperature state with high spectral selectivity and high emissivity, having a property capable of easily identifying whether or not the apparatus is operating, and preventing the temperature of the surface of the heat radiant from becoming hotter than required temperature by controlling the spectral selectivity of spectral emissivity, and thereby marked improvements in safety and energy efficiency can be realized.

2. Description of the Related Art

In general, room heating apparatuses can be classified predominantly into radiating type heating apparatuses that use radiation of infrared radiation, hot air current type heating apparatuses that use forced circulation of a hot air current, and convection type heating apparatuses that use both of the above. Moreover, if a method in which the object to be heated is made to be in close contact with a hot object is excluded, then heating apparatuses in factories, farms and the like, and heating apparatuses for drying timber and the like are fundamentally the same as for room heating apparatuses, and can again be classified into the radiating type, the hot air current type, and the convection type. Furthermore, as one type of radiating type heating apparatus, there are apparatuses in which the spectral selective radiant is made small, and a parabolic reflector is used to concentrate the heat radiation in a certain direction, whereby a desired part only is heated locally. Out of the above types of heating apparatus, in the case of a radiating type heating apparatus or a convection type heating apparatus that uses heat radiation, good heat resistance and high infrared emissivity are required of the heat radiating material that radiates infrared radiation in a high-temperature state, and hence a heat-resistant glass or ceramic has been used.

Moving on, the air exists on the Earth generally absorbs infrared radiation, but it is known that the transmittance of infrared radiation is high in a wavelength range of 8 to 13 $\mu$m known as the 'atmospheric window' (see Solar Energy Utilization Handbook (1985), edited by the Japan Solar Energy Society, p. 45). The absorptance of infrared radiation by the air in wavelength regions other than the 'atmospheric window' can be measured using an ordinary infrared spectrophotometer, and upon actually doing this, it was found that the absorption coefficient at a temperature of 30° C. is approximately 1 $m^{-1}$. This means that most infrared radiation outside the region of the 'atmospheric window' does not travel beyond approximately 3 m, but rather is absorbed by the air.

A conventional radiating type heating apparatus or convection type heating apparatus using a heat-resistant glass or ceramic as described above radiates infrared radiation over a broad range from the near infrared region to the far infrared region unselectively. Consequently, in wavelength regions other than the 'atmospheric window', depending on the distance to the object to be heated, some of the infrared radiation is absorbed by the air, and heating is realized through heat being supplied to the person or object to be heated indirectly from the air; in the wavelength region of the 'atmospheric window', heating is realized through the person or the like receiving radiation directly from the heat radiating material. As a result, even in the case of a heating apparatus that uses a parabolic reflector and thus places importance on directionality, at short distances, the heating effect in which the infrared radiation is received directly will predominate, but at greater distances, there will be a problem that the infrared radiation reaching an object to be heated such as a person from the heating apparatus will only be part of the infrared radiation radiated by the heat radiating material.

As novel heat radiating materials for resolving this problem, spectral selective type heat radiating materials comprising a metal base material and a silicon monoxide film formed thereon are known; such a material selectively radiates infrared radiation in a wavelength range of approximately 8 to 13 $\mu$m, which is the 'atmospheric window' region in which the air is transparent, and by using such a spectral selective type heat radiating material, it becomes possible to efficiently irradiate infrared radiation onto an object to be heated that is far away.

However, a spectral selective type heat radiating material does not transmit visible light, and barely radiates visible light even when radiating heat, and thus is opaque, and hence it is not easy for a user to know whether or not the heat radiating material is in a high-temperature state, i.e. whether or not the heating apparatus is operating; there is thus a problem that there is a risk of getting burned, which is inadequate from a safety perspective. Moreover, if the same amount of electrical power is put into a material that irradiates infrared radiation unselectively and a spectral selective type heat radiating material, then the spectral selective type heat radiating material will get much hotter, and hence there is a problem that the temperature of the surface of the heat radiant may become excessively high, and thus there is an increased risk of a person or the like getting burned upon accidental contact. In view of the above, even in the case that a spectral selective type heat radiating material is used, if, for example, a heating apparatus for which it can be identified at a glance whether or not the heat radiating material is operating, i.e. a spectral selective type heat radiating material and heating apparatus for which the risk of getting burned or the like is not markedly higher than with a conventional heat radiating material that radiates infrared radiation unselectively, could be developed, then the above problems of a spectral selective type heat radiating material could be resolved.

In view of the prior art described above, the present inventors thus carried out assiduous research with an aim of developing a heating apparatus that uses a spectral selective type heat radiating material, and for which it can easily be identified whether or not the heat radiating material is in a high-temperature state, and moreover the risk of being burned or the like is not markedly greater than with a conventional heating apparatus; as a result, the present inventors succeeded in developing a heating apparatus for which the way of forming spectral selective type heat radiating material film parts is changed, and a heating apparatus and spectral selective type heat radiating material for which the spectral selectivity of spectral emissivity is controlled by adjusting the film thickness, thus accomplishing the present invention.

SUMMARY OF THE INVENTION

The present invention has been proposed in view of the above; it is an object of the present invention to provide a heating apparatus that uses a spectral selective type heat radiating material having a property capable of easily identifying whether or not the heating apparatus is operating, and a spectral selective type heat radiating material used in such a heating apparatus, and also a heating apparatus for which the risk of being burned or the like due to an excessive rise in temperature is prevented from increasing markedly, and a spectral selective type heat radiating material used in such a heating apparatus.

To attain the above object, the present invention is constituted from the following technical means.

(1) A heating apparatus that uses a spectral selective type heat radiating material having a high emissivity in a specific wavelength region, characterized in that a film of the spectral selective type heat radiating material is formed on a surface of a heat radiant while leaving at least one region of the surface of the heat radiant with nothing formed thereon, having a property capable of identifying whether or not the heating apparatus is operating and preventing the temperature of a surface of the heat radiant from rising excessively.

(2) The heating apparatus according to (1) above, wherein the film of the spectral selective type heat radiating material comprises a film of a silicon monoxide formed on a metal base material.

(3) The heating apparatus according to (1) above, wherein the spectral selectivity of spectral emissivity is controlled by adjusting the thickness of the film of spectral selective type heat radiating material.

(4) The heating apparatus according to (3) above, wherein the thickness of the film of a metal base material and/or a silicon monoxide that constitutes the film of the spectral selective type heat radiating material is adjusted.

(5) The heating apparatus according to (3) or (4) above, wherein the temperature of a surface of the heat radiant is prevented from becoming higher than required temperature by reducing the spectral selectivity of spectral emissivity.

BRIEF DESCRIPTION OF THE DRAWINGS

FIG. 11 shows another embodiment of the present invention.

DESCRIPTION OF THE PREFERRED EMBODIMENTS

Figure 1A:
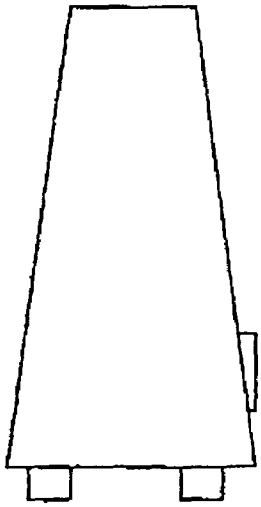
FIGS. 1A and 1B show an electric heater in which aluminum and silicon monoxide have been deposited by vacuum deposition on the surface of one of the heat radiant.

The present invention will now be described in more detail.

Conventionally, for example, in the case of an electric heater that uses a spectral selective type heat radiating material, the heat radiant formed on the surface of the spectral selective radiant, i.e. the heat radiant material, is opaque, and when electrified, it has been difficult to visually verify that the heat radiant is in electrified heated state, and moreover it has not been possible to prevent the temperature of the surface of the heat radiant from becoming higher than necessary; there has thus been a problem that, from the standpoints of safety and energy efficiency, it has been difficult to apply spectral selective type heat radiating material to an electric heater or the like. The present invention makes it possible to resolve these problems.

In the present invention, as a spectral selective type heat radiating material, as described above, a spectral selective type heat radiating material that gives high emissivity in the 'atmospheric window' wavelength region and gives low emissivity in wavelength regions other than this can be used. As this spectral selective type heat radiating material, basically, a material obtained by forming a silicon monoxide film on a substrate of glass or the like that has had a metal base material built up thereon is used; however, so long as the silicon monoxide film gives high emissivity in the 'atmospheric window' wavelength region and gives low emissivity in wavelength regions other than this, there is no limitation to a pure silicon monoxide film, but rather other substances may be mixed in. Moreover, as the metal base material, any metal base material may be used so long as this metal base material has high reflectance in the infrared region and is able to withstand high temperatures; preferable examples include aluminum and silver.

In the present invention, as the spectral selective type heat radiating material, one in which a silicon monoxide film is formed on a heat-resistant metal base material is preferable as described above, but any other spectral selective type heat radiating material having equivalent effects may be similarly used. The heat radiating material itself is not a characteristic feature of the present invention, but rather the present invention is characterized by providing novel technology for the case of manufacturing the heat radiant of an electric heater or the like by using such a heat radiant material.

In the present invention, there are no particular limitations on the method of forming the above-mentioned metal base material and silicon monoxide film, with it being possible to use a sputtering method or another publicly known method. Moreover, for the above-mentioned substrate of glass or the like, there are no particular limitations on the shape or dimensions, with it being possible to make the substrate have any chosen form. Moreover, a coating that is transparent in the infrared region may be provided on the uppermost surface after forming the silicon monoxide film to improve the designability or give a physical protection effect. The spectral selective type heat radiating material used in the present invention has a high emissivity selectively in a wavelength region of 8 to 13 μm, and is useful as a heat radiating material for providing room heating for people or the like, or a heat radiating material for heating in large spaces such as halls, factories and farms; however, there is no limitation thereto, with it being possible to use the spectral selective type heat radiating material for other similar purposes as appropriate.

In the present invention, preferably, the spectral selective type heat radiating material film is formed, for example, on a substrate in which a heat source that uses electrical resistance heating such as a nichrome wire is covered with glass or the like, but in this case one or more region(s) of the surface of the heat radiant is/are left with nothing formed thereon when forming the film, so that the incandescence of the red-hot nichrome wire or the like can be seen via this/these region(s). The components of the film and the formation method are as above, with there being no particular limitations thereon. Moreover, the shape of the heat radiant may be, for example, plate-shaped, bar-shaped, or grid-shaped, and if necessary, for example, a reflector, or a parabolic or concave reflecting mirror or the like may be used on the rear surface. The shape of the part(s) where the film is not formed may be any shape so long as the red-hot heat source can be seen, and moreover the desired effects of the spectral selective type heat radiating material can be obtained, for example slit-shaped, rectangular, square, circular, elliptical, or grid-shaped, and moreover there is no particular limitation on the number of such part(s). The present invention may be applied to any heating apparatus having a heat radiant as described above, regardless of the shape, size, type and so on of the heating apparatus and heat radiant.

The thickness of the silicon monoxide film is, for example, 0.5 to 1.5 μm, but in the present invention, there is no limitation thereto, with it being possible to adjust the thickness of the film, whereby the extent of the spectral selectivity of spectral emissivity can be controlled. Moreover, the extent of the wavelength selectivity can also be controlled by controlling the thickness of the film of the metal base material on the substrate of glass or the like.

In the present invention, it is important that the film of the spectral selective type heat radiating material is formed not over the whole of the surface of, for example, the tubular heat-resistant glass heat radiant, but rather leaving one or more region(s) with nothing formed thereon. As a result, it becomes possible to visually verify the electrified heated state of the heat radiant through the heat radiant glowing red in this/these region(s); moreover, due to using the spectral selective type heat radiating material, the temperature of the surface of the heat radiant can be prevented from becoming higher than necessary.

In this case, the region of formation of the film of the spectral selective type heat radiating material can be designed as deemed appropriate in accordance with the shape and type and so on of the heat radiant in the heating apparatus, giving consideration to the working effect described above being exhibited sufficiently.

In the present invention, as described above, by adjusting the thickness of the film of the spectral selective type heat radiating material, the extent of the spectral selectivity of spectral emissivity can be controlled; for example, by making the thickness of the film of the heat radiant material higher, the infrared reflectance becomes lower, i.e. the emissivity becomes higher, and the spectral selectivity can be reduced, and as a result the temperature of the surface of the heat radiant can be prevented from becoming higher than necessary. In the present invention, by adjusting the region and method of formation of the film of the spectral selective type heat radiating material on the heat radiant, and the thickness of the film of the heat radiating material, it can be made such that it is possible to visually verify that the heat radiant using the spectral selective type heat radiating material is in a high-temperature state due to being electrified and heated, and moreover it can be made such that the temperature of the surface of the heat radiant can be prevented from rising excessively; a heating effect using the heat radiant can thus be obtained safely, with energy-saving, and with high radiation efficiency. In the present invention, as a result of the above, a working effect that could not be predicted whatsoever from prior art is exhibited in that it is possible to provide a novel type of heating apparatus that uses a spectral selective type heat radiating material so that spectral selectivity is improved, and for which safety and energy efficiency are improved.

EXAMPLES

Next, a detailed description of the present invention will be given through examples; however, the present invention is not limited whatsoever by the following examples.

Example 1

Figure 1B:
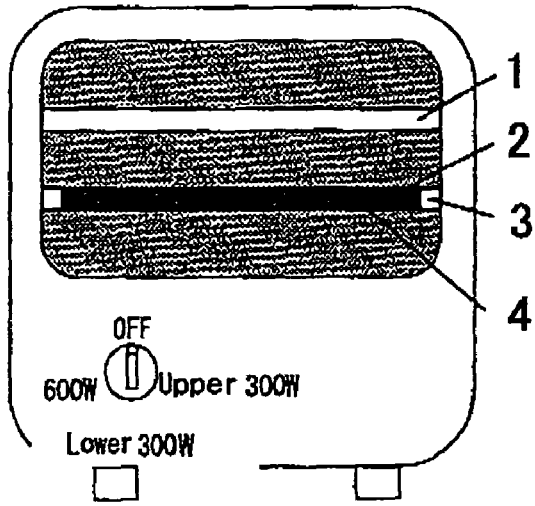

Using an electric heater in which two tubular heat-resistant glass heat radiant (1 and 2)were installed horizontally so as to be in parallel with one another and at different heights, aluminum and silicon monoxide were deposited by vacuum deposition onto the surface of one of the heat radiants, thus forming a spectral selective type heat radiating material (4). However, a part of length approximately 1 cm having nothing deposited thereon (3) was left at each end of the heat radiant (FIG. 1). The two heat radiants were electrified, whereupon the whole of the heat radiant that had not been made into a spectral selective type heat radiating material glowed red, and hence it could be verified that the heat radiant was in an electrified heated state. Moreover, with the spectral selective type heat radiating material as well, the parts of the glass tube having nothing deposited thereon glowed red, and hence it could be verified that the heat radiant was in an electrified heated state.

Comparative Example 1

Using an electric heater in which two tubular heat-resistant glass heat radiants were installed horizontally so as to be in parallel with one another and at different heights, aluminum and silicon monoxide were deposited by vacuum deposition over the whole surface of one of the heat radiants, thus forming a spectral selective type heat radiating material. The two heat radiants were electrified, whereupon the whole of the heat radiant that had not been made into a spectral selective type heat radiating material glowed red, and hence it could be verified that the heat radiant was in an electrified heated state. On the other hand, with the spectral selective type heat radiating material, it could not visually verified that the heat radiant was in a high-temperature state due to having been electrified and heated.

Comparative Example 2

Figure 2:
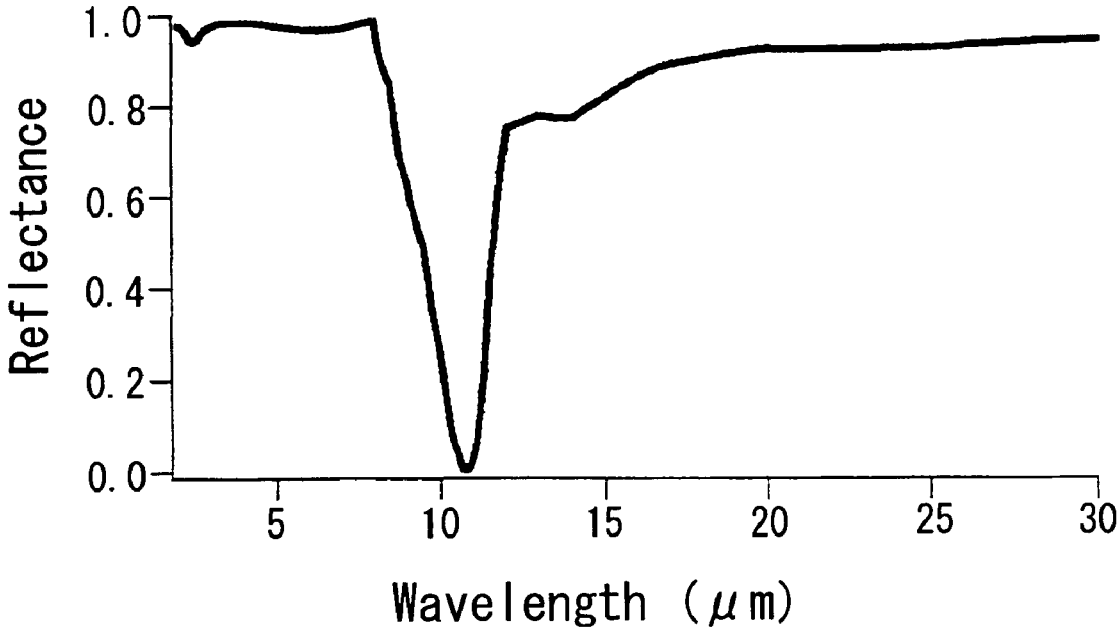
FIG. 2 shows the infrared reflectance in the case that the silicon monoxide film thickness is 1 $\mu$m.

Aluminum and silicon monoxide were deposited by vacuum deposition onto a glass substrate, with the aluminum being built up to 200 nm, and the silicon monoxide to 1 μm. As a result of determining the infrared reflectance of the resulting sample, as shown in FIG. 2, it was found that the reflectance was low specifically in a region of 8 to 13 μm and hence the sample was opaque, and thus the absorptance, and hence the emissivity, were high in this wavelength region.

Example 2

Figure 3:
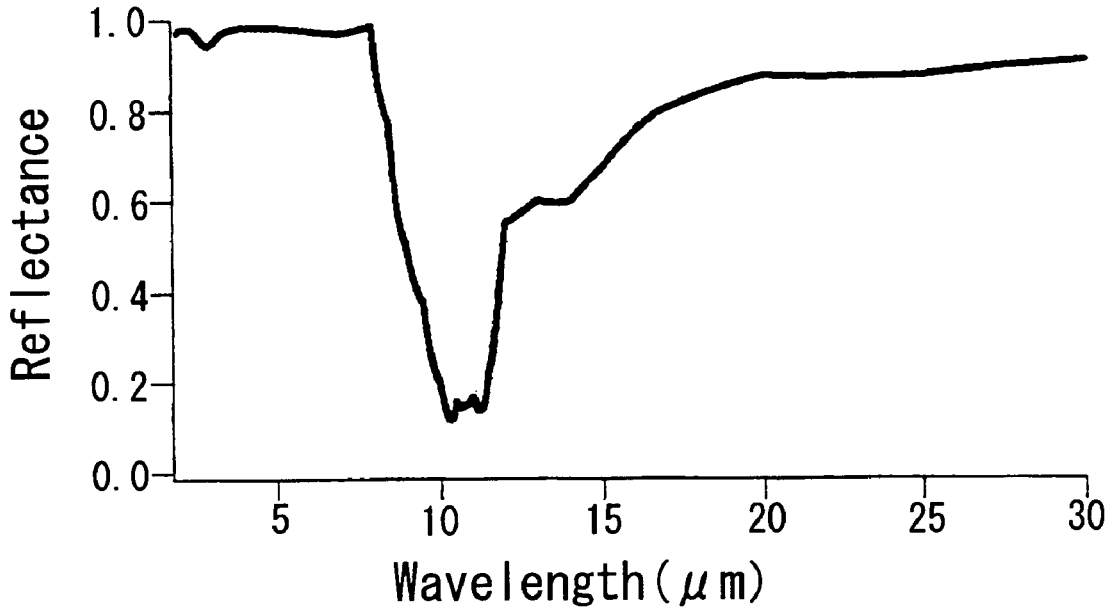
FIG. 3 shows the infrared reflectance in the case that the silicon monoxide film thickness is 1.2 $\mu$m.

Aluminum and silicon monoxide were deposited by vacuum deposition onto a glass substrate, with the aluminum being built up to 200 nm, and the silicon monoxide to 1.2 μm. As a result of determining the infrared reflectance of the resulting sample, as shown in FIG. 3, it was found that the reflectance was low specifically in a region of 8 to 13 μm and hence the sample was opaque, and thus the absorptance, and hence the emissivity, were high in this wavelength region; however, it was also found that in the wavelength region around 15 μm, the reflectance was lower than in FIG. 2, i.e. the emissivity was higher, and hence the spectral selectivity was lower than in FIG. 2.

Example 3

Figure 4:
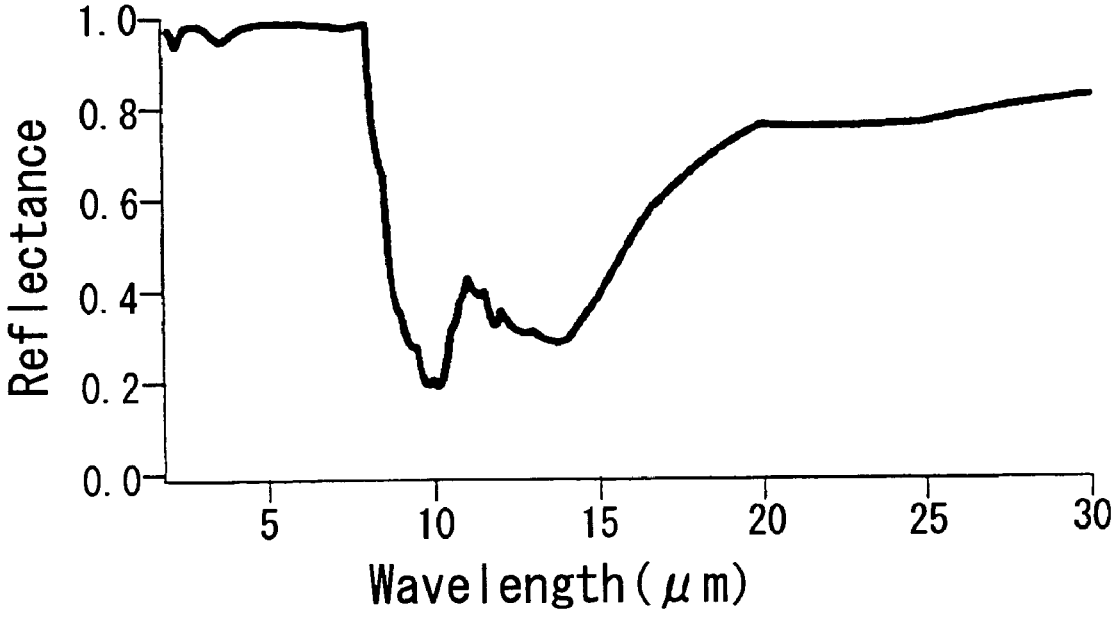
FIG. 4 shows the infrared reflectance in the case that the silicon monoxide film thickness is 1.5 $\mu$m.

Aluminum and silicon monoxide were deposited by vacuum deposition onto a glass substrate, with the aluminum being built up to 200 nm, and the silicon monoxide to 1.5 μm. As a result of determining the infrared reflectance of the resulting sample, as shown in FIG. 4, it was found that the reflectance was low specifically in a region of 8 to 13 μm, but not as low as in FIG. 2 or 3. Moreover, it was also found that in the wavelength region around 15 μm, the reflectance was lower than in FIG. 2, i.e. the emissivity was higher, and hence the spectral selectivity was lower than in FIG. 2.

Example 4

200 nm of aluminum and 1.5 μm of silicon monoxide were deposited by vacuum deposition onto a glass substrate of diameter 5 cm, thus producing a sample. The parts of the sample other than the surface of the heat radiant were covered with a heat insulating material (rock wool), and 20 W of thermal energy was put in from the back of the substrate using a ceramic heater. The temperature of the surface of the heat radiant was measured using a thermocouple to be approximately 220° C., and hence it was found that by making the silicon monoxide film thickness be higher, the rise in temperature of the surface of the heat radiant could be markedly suppressed compared with a comparative example (Comparative Example 3).

Moreover, heat-resistant black paint was applied onto a glass substrate of diameter 5 cm, thus producing a sample. The parts of the sample other than the surface of the heat radiant were covered with a heat insulating material (rock wool), and 20 W of thermal energy was put in from the back of the substrate using a ceramic heater. The temperature of the surface of the heat radiant was measured using a thermocouple to be approximately 200° C.

Comparative Example 3

200 nm of aluminum and 1 μm of silicon monoxide were deposited by vacuum deposition onto a glass substrate of diameter 5 cm, thus producing a sample. The parts of the sample other than the surface of the heat radiant were covered with a heat insulating material (rock wool), and 20 W of thermal energy was put in from the back of the substrate using a ceramic heater. The temperature of the surface of the heat radiant was measured using a thermocouple to be approximately 250° C.

Moreover, heat-resistant blank paint was applied onto a glass substrate of diameter 5 cm, thus producing a sample. The parts of the sample other than the surface of the heat radiant were covered with a heat insulating material (rock wool), and 20 W of thermal energy was put in from the back of the substrate using a ceramic heater. The temperature of the surface of the heat radiant was measured using a thermocouple to be approximately 200° C.

Example 5

An aluminum film of thickness 200 nm was formed by sputtering on each of five square glass substrates of side 1 cm, and then a silicon monoxide film was formed by sputtering to a thickness of 100 nm, 250 nm, 500 nm, 1 μm, 1.5 μm, or 2 μm on top of the aluminum film of each glass substrate, thus producing samples A, B, C, D, E and F.

The infrared spectral reflectance was measured for each of the samples, and the results were as shown in FIGS. 5 to 10.

Figure 5:
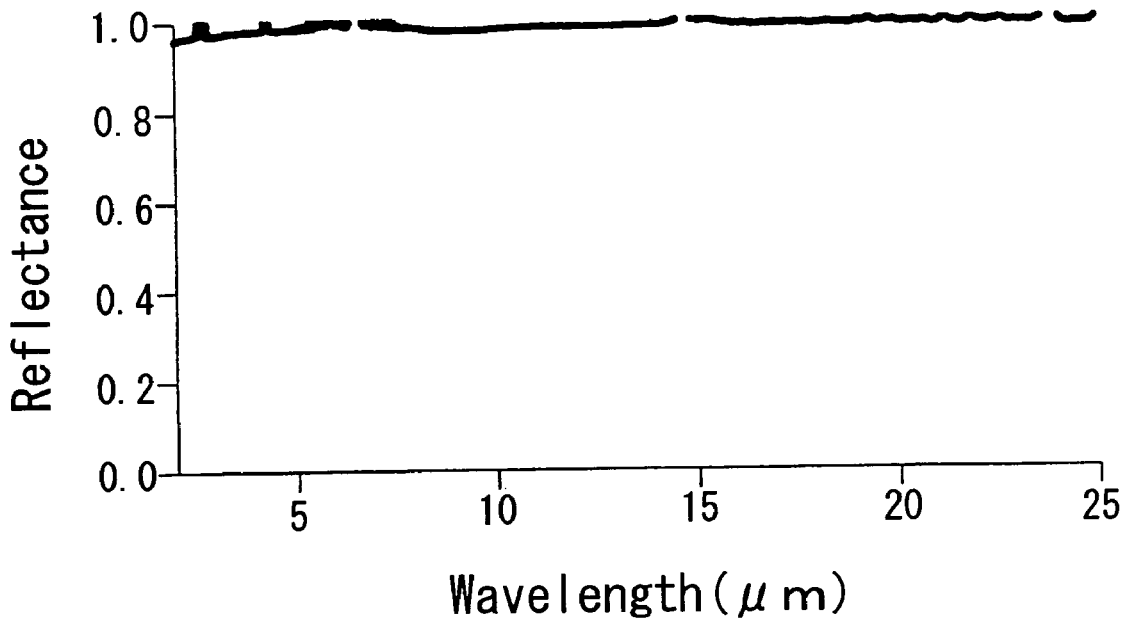
FIG. 5 shows measured values of the infrared spectral reflectance of a silicon monoxide film of thickness 100 nm on an aluminum film formed by sputtering on a glass substrate.
Figure 6:
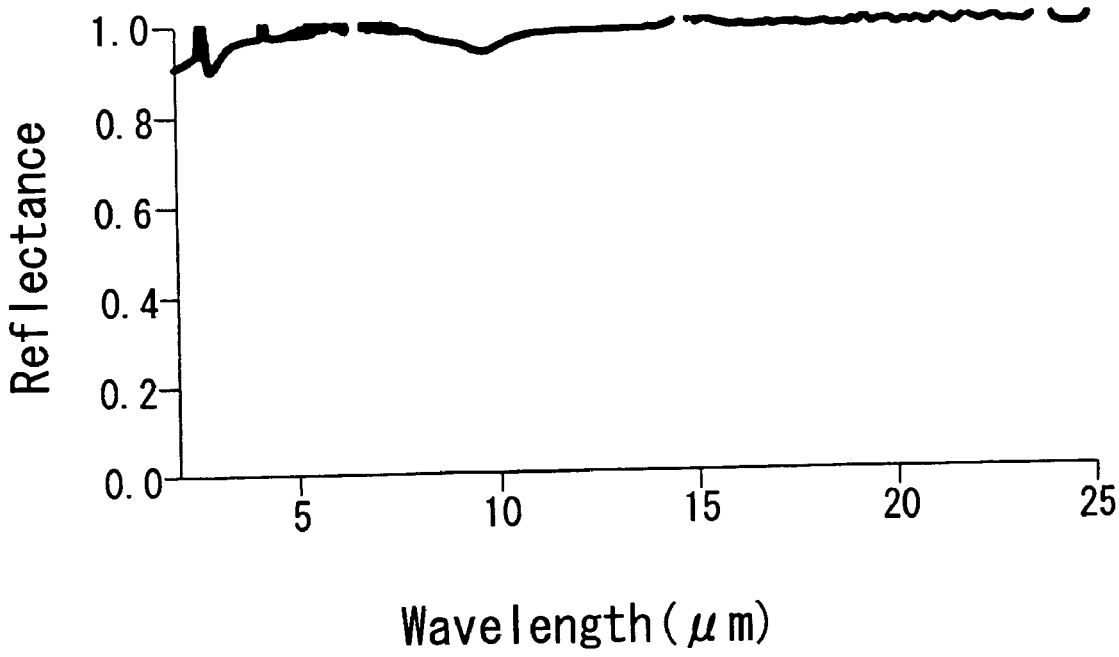
FIG. 6 shows measured values of the infrared spectral reflectance of a silicon monoxide film of thickness 250 nm on an aluminum film formed by sputtering on a glass substrate.
Figure 7:
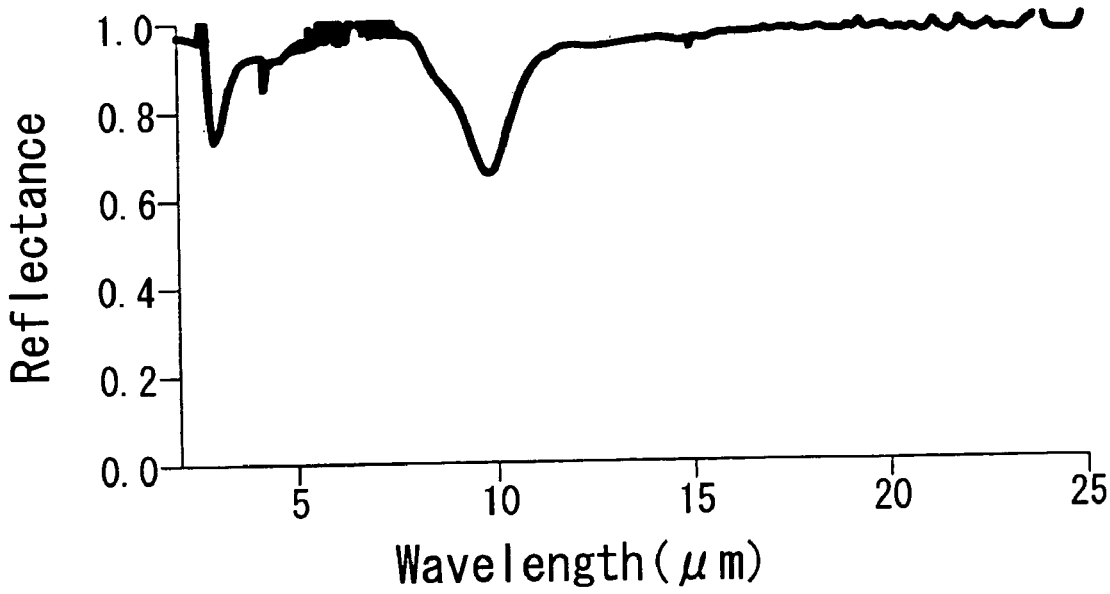
FIG. 7 shows measured values of the infrared spectral reflectance of a silicon monoxide film of thickness 500 nm on an aluminum film formed by sputtering on a glass substrate.
Figure 8:
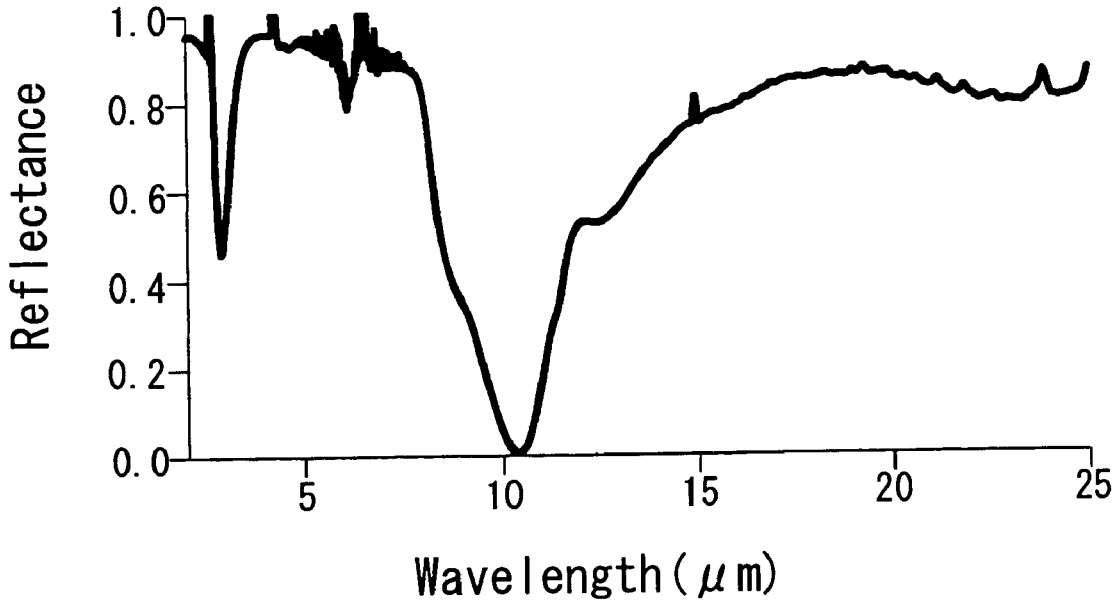
FIG. 8 shows measured values of the infrared spectral reflectance of a silicon monoxide film of thickness 1 $\mu$m on an aluminum film formed by sputtering on a glass substrate.
Figure 9:
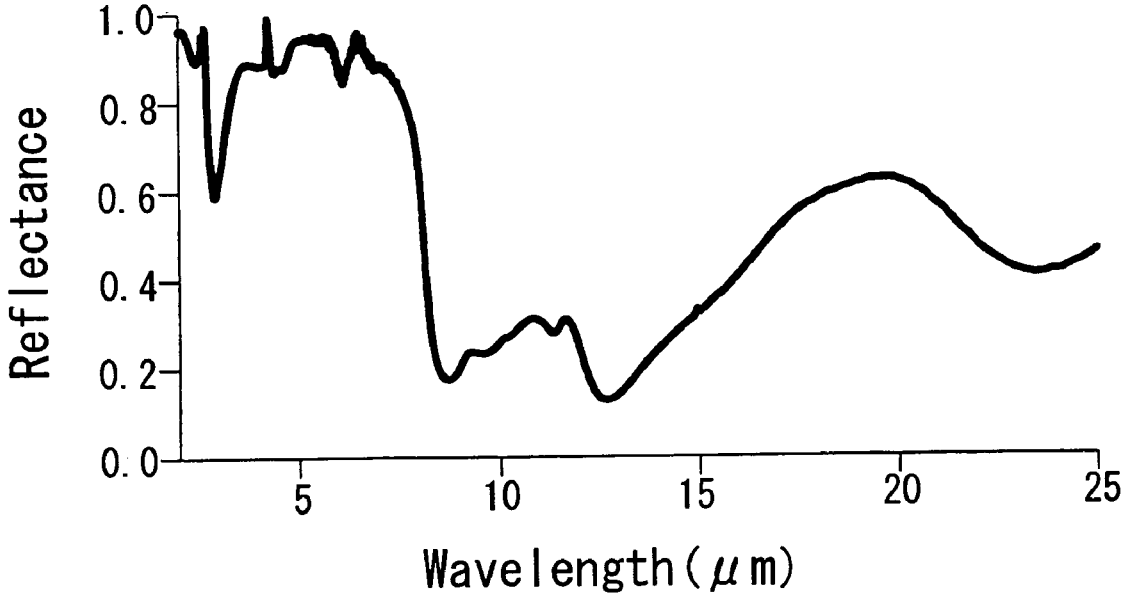
FIG. 9 shows measured values of the infrared spectral reflectance of a silicon monoxide film of thickness 1.5 $\mu$m on an aluminum film formed by sputtering on a glass substrate.
Figure 10:
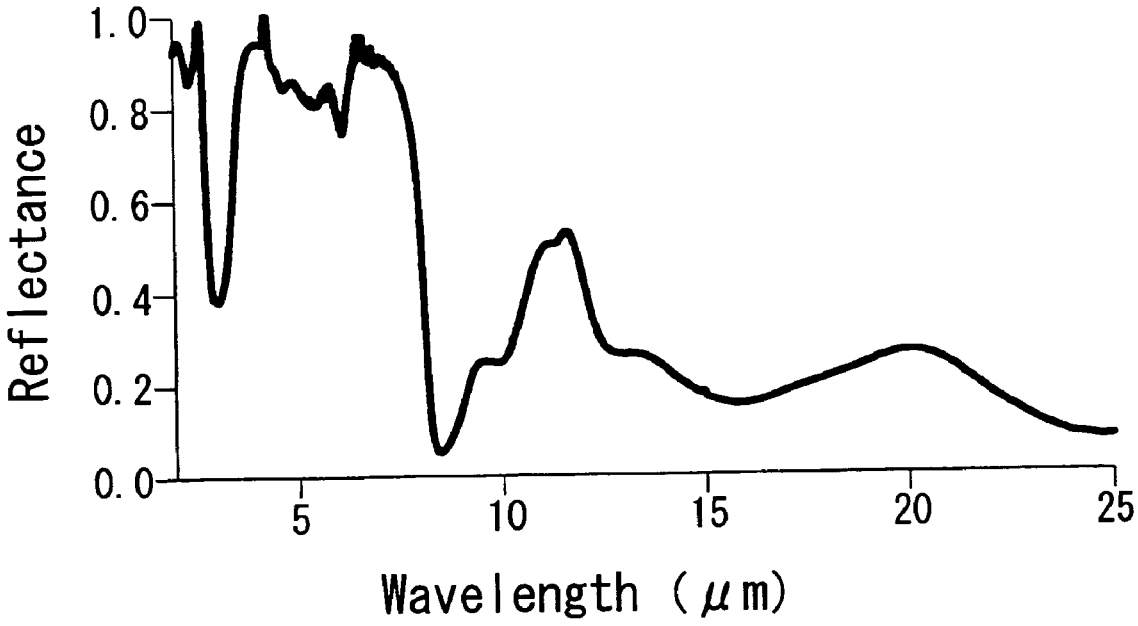
FIG. 10 shows measured values of the infrared spectral reflectance of a silicon monoxide film of thickness 2 $\mu$m on an aluminum film formed by sputtering on a glass substrate.

In FIGS. 5 and 6, the silicon monoxide film was too thin, and hence the result was that the reflectance was high, i.e. the emissivity was low, over the whole of the infrared region. In FIG. 7, a drop in the reflectance in the 'atmospheric window' region can be seen, but the spectral selectivity is not as marked as in FIG. 2. In FIG. 8, a drop in the reflectance around a wavelength of 3 μm which is thought to be due to the difference in manufacturing method can be seen, but moreover the reflectance drops greatly in the 'atmospheric window' region, and hence the spectral selectivity is marked. In FIGS. 9 and 10, as the silicon monoxide film thickness becomes too high, the spectral selectivity clearly drops.

From the above results, in the case of using each of the above samples as a spectral selective radiant and putting in a certain electrical power, for samples A and B, it is readily envisaged that the temperature thereof will become much higher than with the spectral selective type heat radiating materials; for sample C, infrared radiation is radiated in the 'atmospheric window' region, and hence the temperature thereof will not become as high as with samples A and B, but the temperature thereof will become higher than with sample D, which is close to an ideal spectral selective type heat radiating material; for samples E and F, the spectral selectivity drops, and moreover the emissivity over the infrared region as a whole is higher, and hence the infrared radiation characteristics will become close to those of a black body, and thus the temperature thereof will be lower than for sample D and hence risk will be reduced.

As described in detail above, the present invention relates to a heating apparatus that uses a spectral selective type heat radiating material; the present invention achieves the following effects: 1) a heating apparatus that uses a spectral selective type heat radiating material can be provided for which it can easily be identified whether or not the heating apparatus is operating; 2) by adjusting the thickness of the film of the heat radiating material, the spectral selectivity of spectral emissivity can be controlled; 3) as a result, the temperature of the surface of the heat radiant can be prevented from becoming higher than required temperature, i.e. can be prevented from rising excessively; 4) a heating apparatus having improved safety and energy efficiency can be provided; 5) a heating apparatus that uses a spectral selective type heat radiating material and has high heating efficiency can be made practicable.

What is claimed is:

1. A heating apparatus, comprising a heat radiant having a surface; and a film having a predetennined thickness and including a spectral selective type heat radiating material, said film applied to a first region of said surface while leaving another region of the surface without a film formed thereon, wherein said film includes a silicon monoxide formed on a metal base material, and the predetermined thickness corresponds to a predetermined spectral selectivity of spectral emissivity in a predetermined wavelength region.

2. The heating apparatus according to claim 1, wherein said predetermined thickness includes one of a predetermined thickness of the metal base material and a predetermined thickness of the silicon monoxide.

3. The heating apparatus according to claim 1, wherein the predetermined thickness corresponds to a predetermined temperature rise characteristic.

* * * * *